US008090289B2

(12) United States Patent
Maeda et al.

(10) Patent No.: US 8,090,289 B2
(45) Date of Patent: Jan. 3, 2012

(54) CHARGING DEVICE AND AN IMAGE FORMING APPARATUS PROVIDED WITH THE CHARGING DEVICE

(75) Inventors: Osamu Maeda, Sanda (JP); Shunichi Takaya, Hino (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 12/828,329

(22) Filed: Jul. 1, 2010

(65) Prior Publication Data

US 2011/0002707 A1 Jan. 6, 2011

(30) Foreign Application Priority Data

Jul. 2, 2009 (JP) ..... 2009-157687

(51) Int. Cl.
*G03G 15/02* (2006.01)

(52) U.S. Cl. ..... 399/100

(58) Field of Classification Search ..... 399/100, 399/99, 170, 173; 361/213, 222, 225, 229; 250/324–326
See application file for complete search history.

(56) References Cited

U.S. PATENT DOCUMENTS

| | | | | |
|---|---|---|---|---|
| 5,023,748 | A * | 6/1991 | Okamoto et al. | 399/100 |
| 5,170,314 | A * | 12/1992 | Saito | 361/225 |
| 5,940,656 | A * | 8/1999 | Hensel | 399/100 |

FOREIGN PATENT DOCUMENTS

| | | | |
|---|---|---|---|
| JP | 04-337761 | A | 11/1992 |
| JP | 05-297688 | A | 11/1993 |
| JP | 9-114203 | A | 5/1997 |
| JP | 9-190051 | A | 7/1997 |
| JP | 11-258891 | A | 9/1999 |
| JP | 2004-109721 | A | 4/2004 |
| JP | 2005-140911 | A | 6/2005 |
| JP | 2006-317789 | A | 11/2006 |
| JP | 2006-330115 | A | 12/2006 |
| JP | 2007-256672 | A | 10/2007 |

* cited by examiner

*Primary Examiner* — Susan Lee
(74) *Attorney, Agent, or Firm* — Buchanan Ingersoll & Rooney PC

(57) ABSTRACT

A charging device has a sheet electrode with triangular pins aligned in a first direction and a cleaner unit for cleaning the sheet electrode while moving in the first direction and in a second direction opposite to the first direction. The cleaner unit has a grinding member for grinding the sheet electrode, a first collecting member, which is disposed downstream in the first direction from the grinding member, for collecting extraneous matter, a second collecting member, which is disposed downstream in the second direction from the grinding member, for collecting extraneous matter, and a switching section for changing a contact state of the first collecting member with the sheet electrode and a contact state of the second collecting member with the sheet electrode. While the cleaner unit is moving in the first direction, the second collecting member is pressed against the sheet electrode with greater force than the first collecting member is pressed against the sheet electrode, and while the cleaner unit is moving in the second direction, the first collecting member is pressed against the sheet electrode with greater force than the second collecting member is pressed against the sheet electrode.

7 Claims, 11 Drawing Sheets

CHARGING DEVICE AND AN IMAGE FORMING APPARATUS PROVIDED WITH THE CHARGING DEVICE

This application is based on Japanese Patent Application No. 2009-157687 filed on Jul. 2, 2009, of which content is incorporated herein by reference.

BACKGROUND OF THE INVENTION

1. Field of the Invention

The present invention relates to a charging device and an image forming apparatus provided with the charging device, and more particularly to a charging device for charging an image bearing member and an image forming apparatus provided with the charging device.

2. Description of Related Art

An example of conventional charging devices is a charging device as disclosed by Japanese Patent Laid-Open Publication No. 11-258891 (Reference 1). FIG. 13 shows a part of the charging device 500 disclosed by Reference 1.

In FIG. 13, a charging wire 501, grinding pads 502 and 504, cleaning pads 506 and 508 are shown. The charging wire 501 is one wire, and a high voltage is applied to the charging wire 501 from a high-voltage source. Thereby, a discharge from the charging wire 501 occurs. As the discharge occurs again and again, silicon oxide and other substances adhere to the charging wire 501, and corona products, which are called as needles, are formed on the charging wire 501. Due to the corona products, the discharge from the charging wire 501 becomes uneven, thereby causing a fault in charging. This is a cause of image noise.

In order to avoid this trouble, the grinding pads 502 and 504 are moved in a direction shown by arrow "A" while nipping the charging wire 501 in-between. Thereby, the corona products adhering to the charging wire 501 is ground by the grinding pads 502 and 504. Following the grinding pads 502 and 504, the cleaning pads 506 and 508 are moved in the direction "A" while nipping the charging wire 501 in-between. Thereby, abrasive grains that peeled off from the grinding pads 502 and 504 and the corona products are wiped out. Thus, in the charging device 500, the charging wire 501 is cleaned by two processes, namely, grinding and wiping.

In recent years, charging devices of a type having a sheet electrode with aligned triangular pins are replacing charging devices 500 of the above-described type having a charging wire. The type of charging devices having a sheet electrode has the advantage over the charging device disclosed by Reference 1 of generating less ozone. However, the type of charging devices having a sheet electrode has the same problem as the charging device disclosed by Reference 1 in that corona products are generated. Therefore, also in this type of charging devices, it is necessary to clean the sheet electrode regularly.

The type of charging devices having a sheet electrode has also a problem that the pins are fragile. FIGS. 14*a* and 14*b* show wiping of a sheet electrode 600.

More specifically, an exemplary way of cleaning the sheet electrode 600 is touching grinding pads and cleaning pads as disclosed by Reference 1 to main surfaces of the sheet electrode 600. As the grinding pads, for example, sheets 601 with abrasive grains scattered thereon are used. As the cleaning pads, for example, two pieces of pile fabric 602 with brush fibers standing thereon as shown in FIGS. 14*a* and 14*b* are used. As shown by FIG. 14*a*, by moving the sheets 601 and the pieces of pile fabric 602 in a direction shown by arrow "B", it is possible to grind and wipe off corona products from the sheet electrode 600.

In the charging device having the sheet electrode 600, however, when the sheets 601 and the pieces of pile fabric 602 are moved in the direction "B" and thereafter moved in a direction "C" opposite to the direction "B", the fibers of the pile fabric 602 may twist around the pins of the sheet electrode 600. As shown by FIG. 14*a*, while the sheets 601 and the pieces of pile fabric 602 are moving in the direction "B", the fibers of the pile fabric 602 are pulled by a frictional force with the sheet electrode 600 and trail down slanting to the direction "C", which is the opposite direction to the direction "B". Thereafter, when the pieces of pile fabric 602 are moved in the direction "C" shown by FIG. 14*b*, the fibers of the pile fabric 602 are pulled in the direction "B" and are turning around from the direction "C" to the direction "B". In this moment, the fibers of the pile fabric 602 may twist around the pins of the sheet electrode 600, thereby possibly causing bends of the pins of the sheet electrode 600. Then, bends of the tips of the pins of the sheet electrode 600 will cause a charging fault, thereby resulting in degradation of the picture quality.

SUMMARY OF THE INVENTION

An object of the present invention is to provide a charging device wherein breaks of triangular pins of a sheet electrode can be prevented, and an image forming apparatus provided with the charging device.

According to a first aspect of the present invention, a charging device comprises: a sheet electrode for charging an image bearing member, the sheet electrode comprising triangular pins aligned in a first direction; and a cleaner unit for cleaning the sheet electrode while moving in the first direction and in a second direction opposite to the first direction, the cleaner unit comprising: a grinding member for grinding the sheet electrode; a first collecting member for collecting extraneous matter, the first collecting member being disposed downstream in the first direction from the grinding member; a second collecting member for collecting extraneous matter, the second collecting member being disposed downstream in the second direction from the grinding member; and a switching section for switching a contact state of the first collecting member with the sheet electrode and a contact state of the second collecting member with the sheet electrode, such that while the cleaner unit is moving in the first direction, the second collecting member is pressed against the sheet electrode with greater force than the first collecting member is pressed against the sheet electrode, and such that while the cleaner unit is moving in the second direction, the first collecting member is pressed against the sheet electrode with greater force than the second collecting member is pressed against the sheet electrode.

According to a second aspect of the present invention, an image forming apparatus comprises the charging device.

BRIEF DECRIPTION OF THE DRAWINGS

This and other objects and features of the present invention will be apparent from the following description with reference to the accompanying drawings in which.

Figures 4A, 4B, 4C:
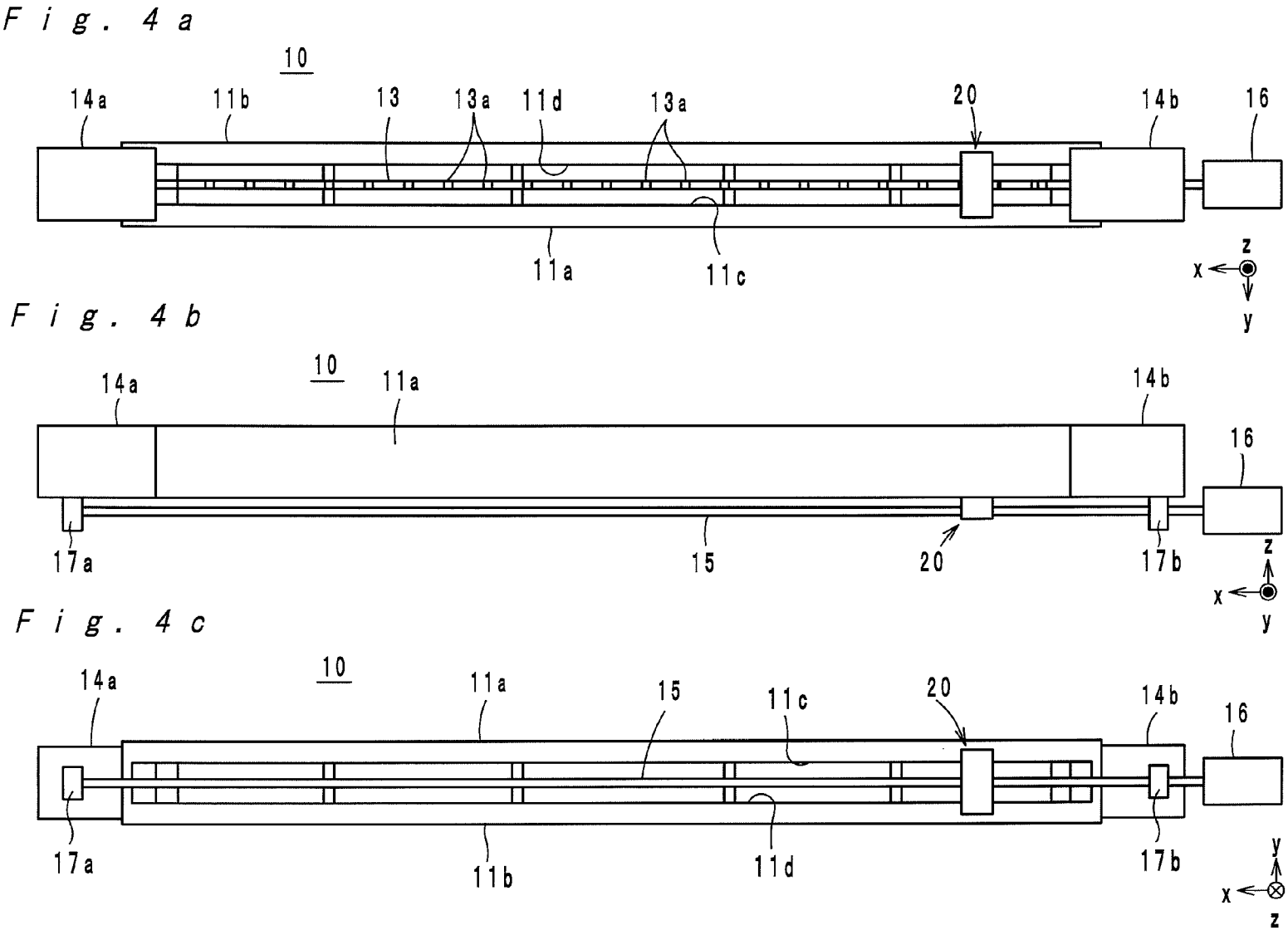
Figure 5:
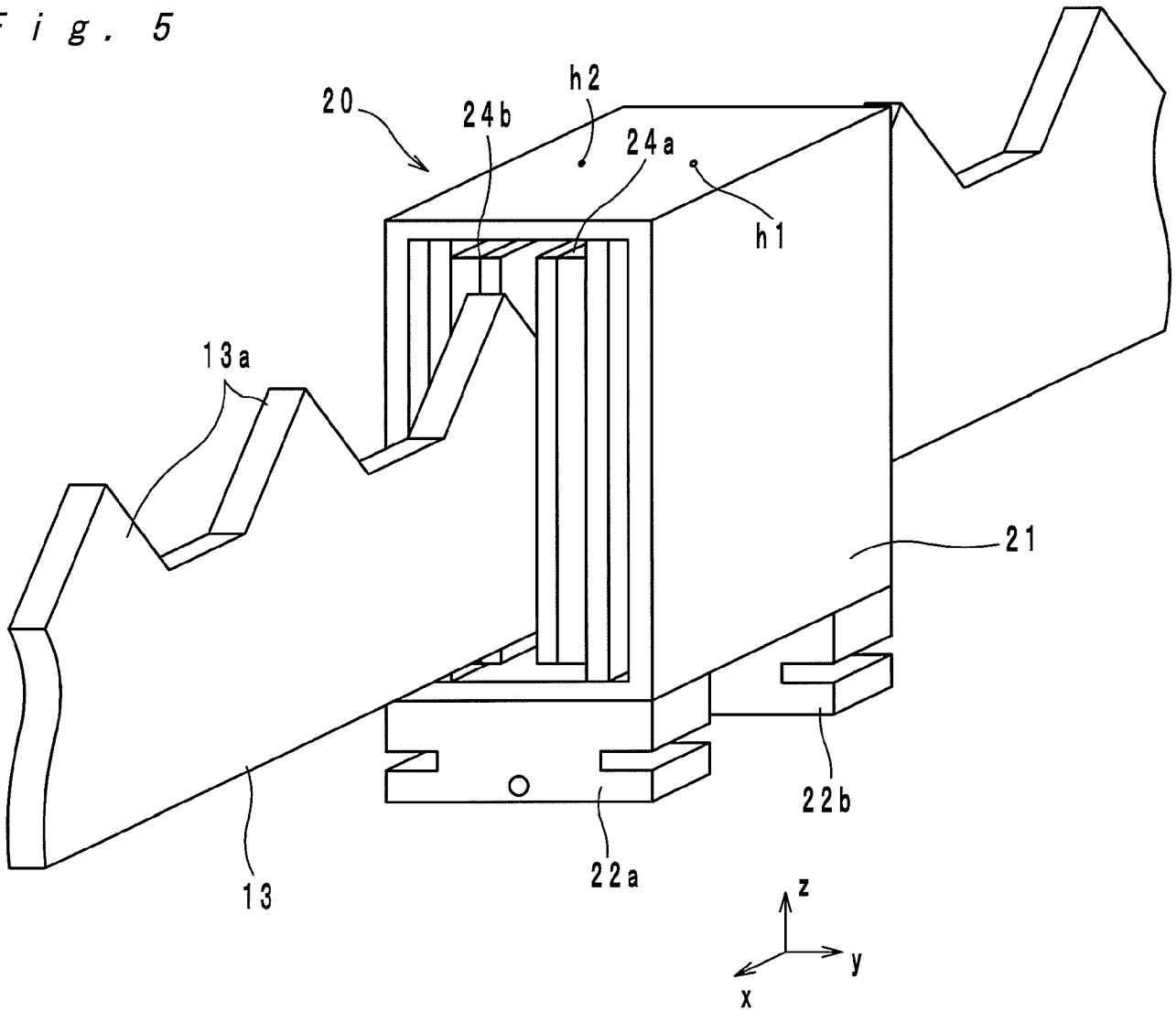
Figure 6:
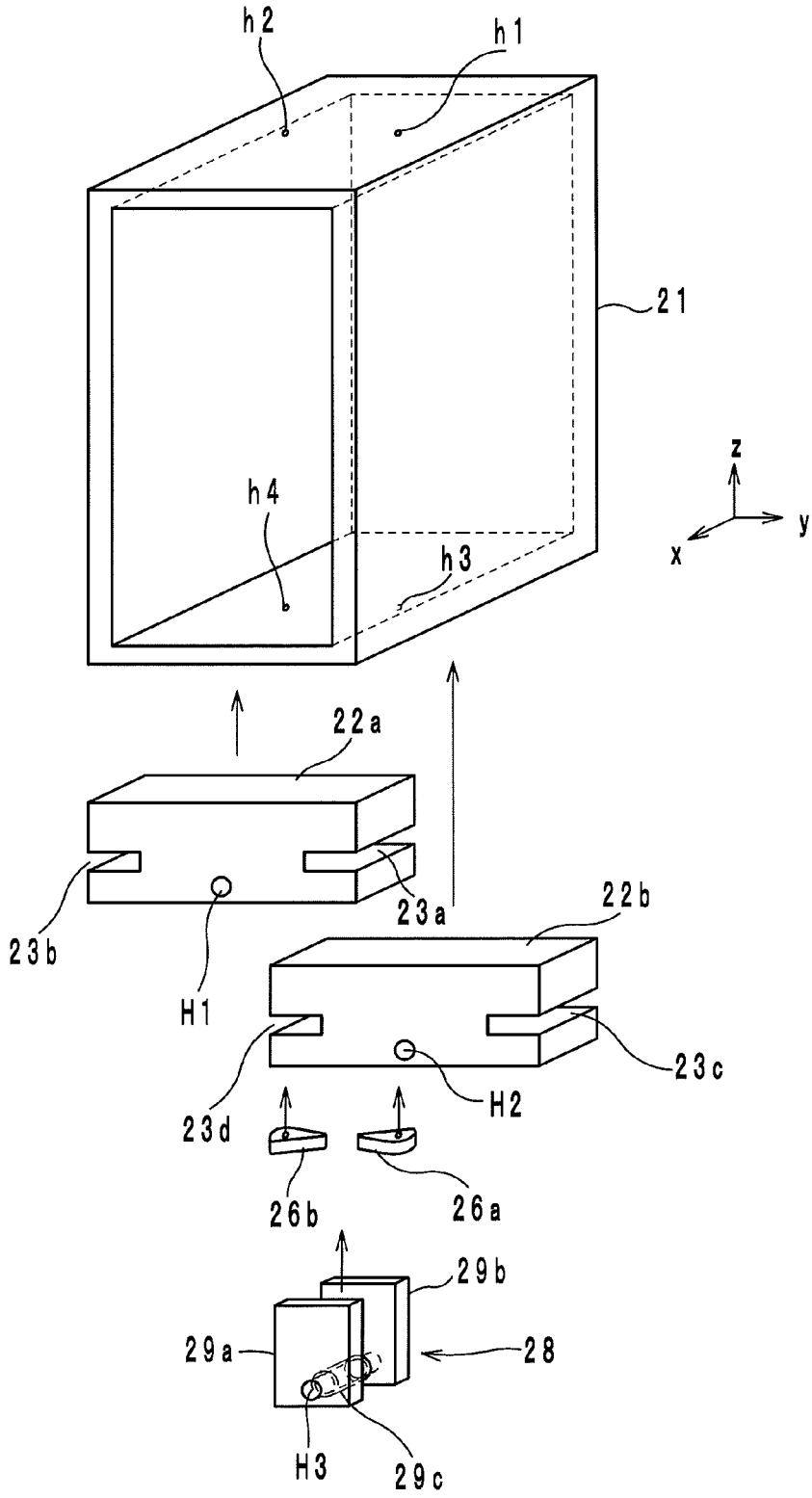
Figure 7A:
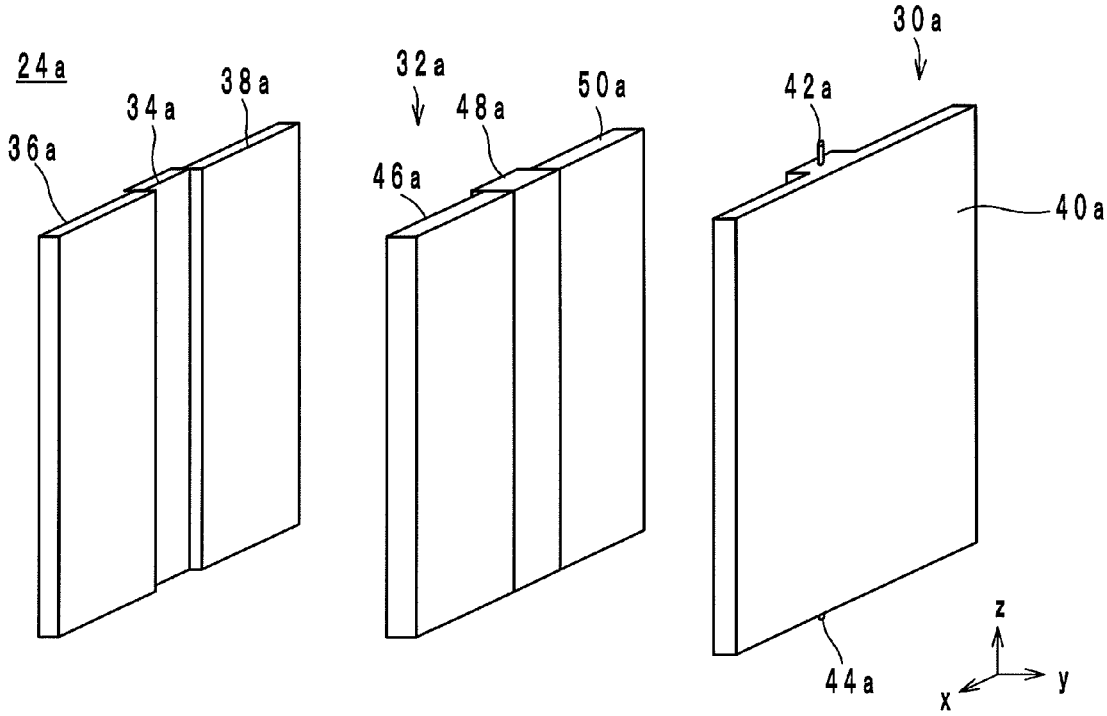
Figure 7B:
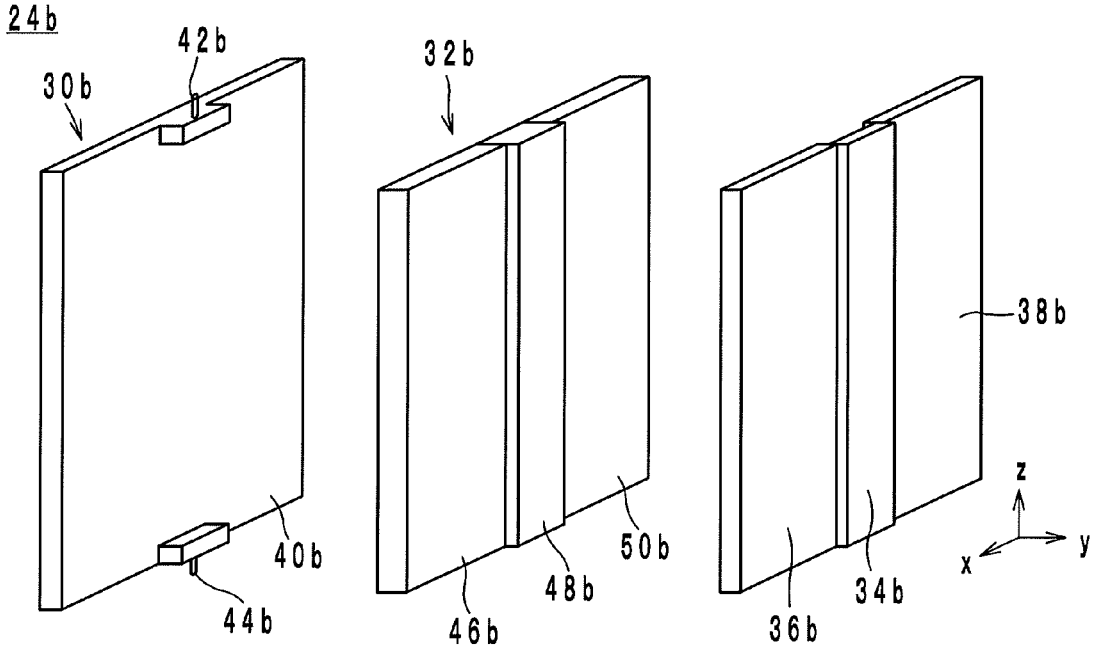
Figure 8A:
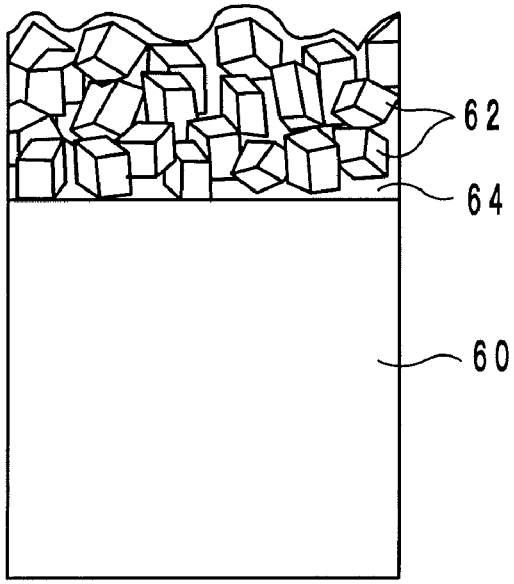
Figure 8B:
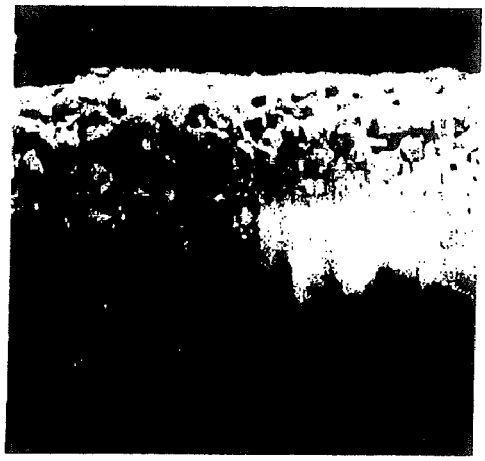
Figure 9:
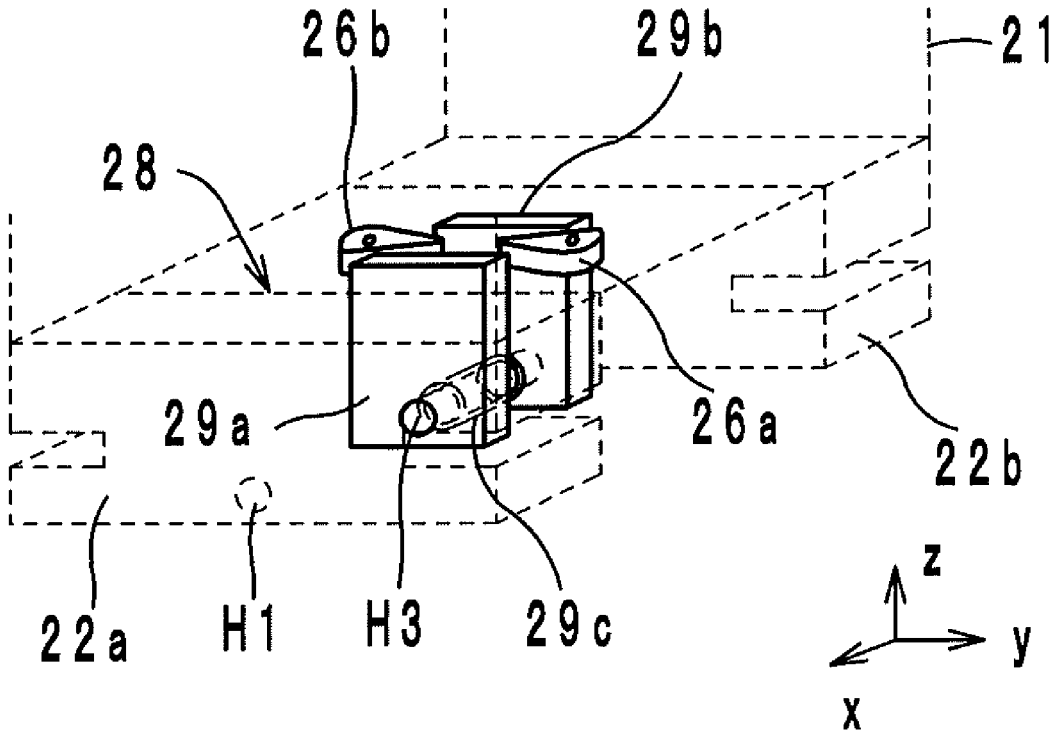
Figure 10A:
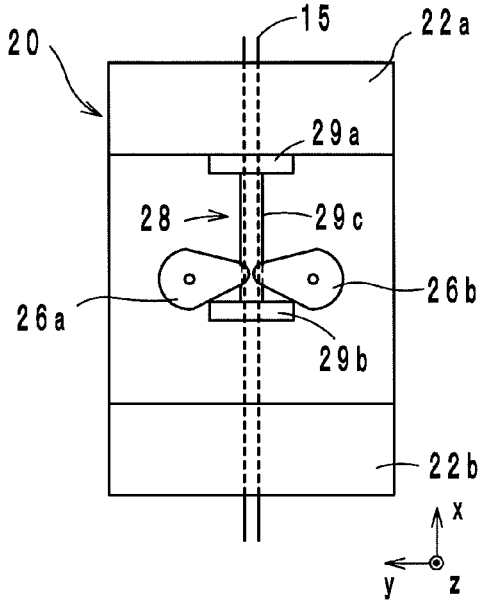
Figure 10B:
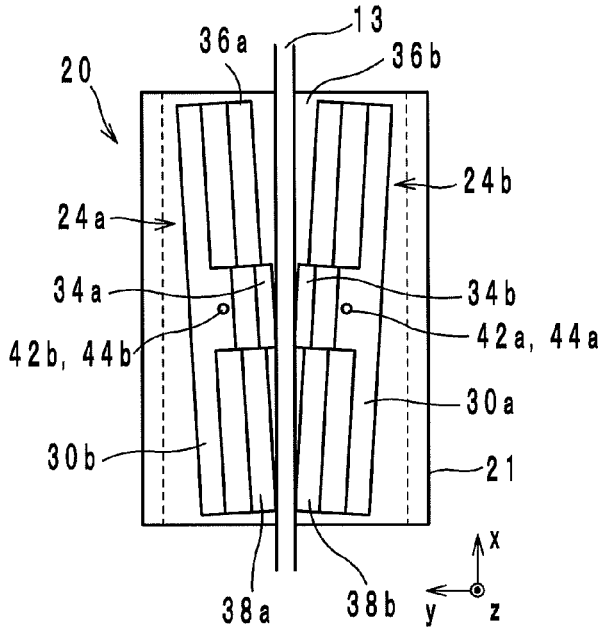
Figure 11A:
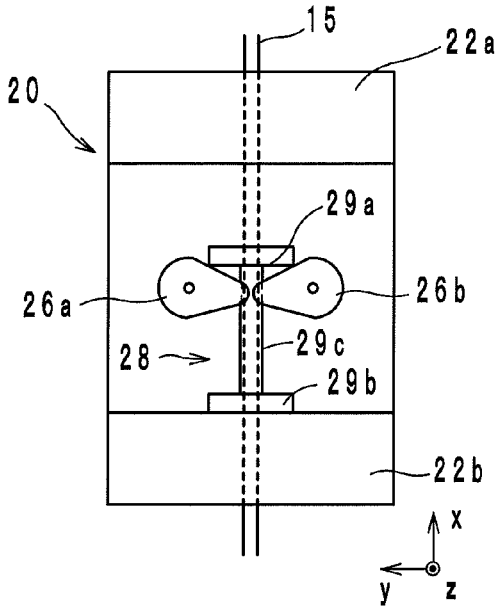
Figure 11B:
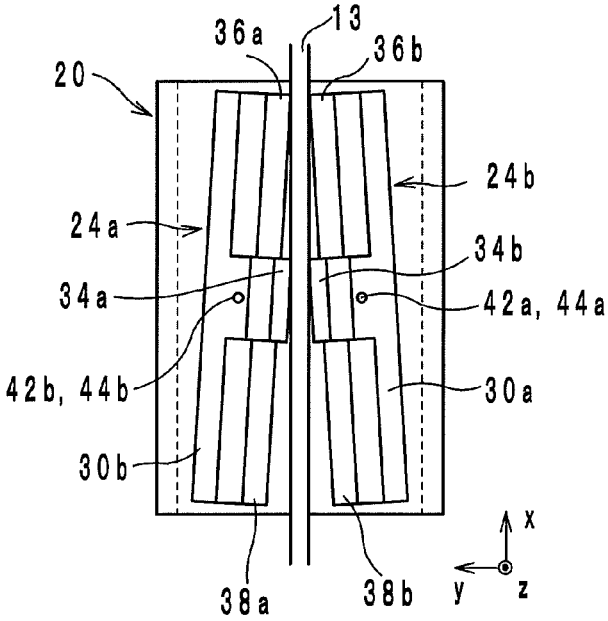
Figure 12:
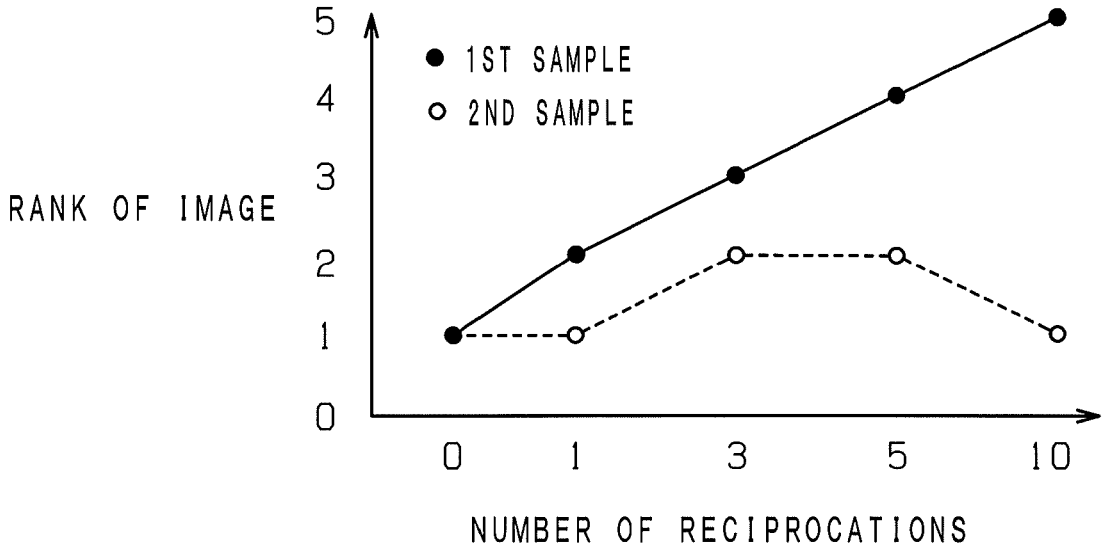
Figure 13:
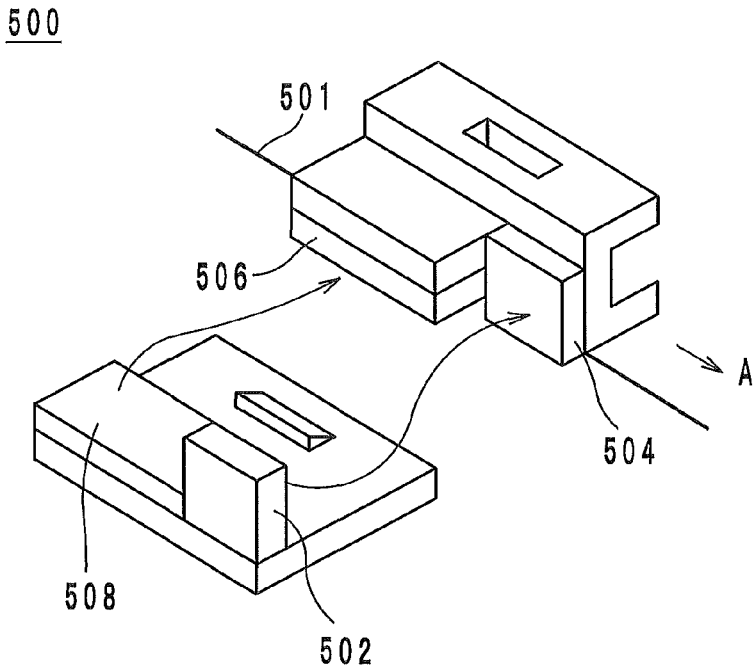
Fig. 13 Prior Art
Figure 14A:
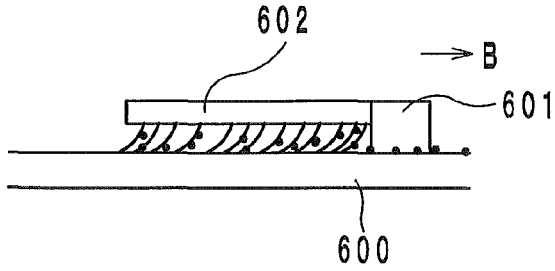
Fig. 14a Prior Art
Figure 14B:
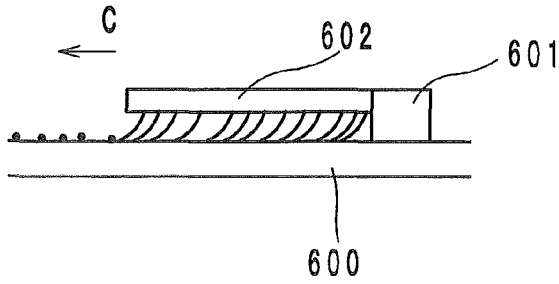
Fig. 14b Prior Art

FIGS. 4*a*, 4*b* and 4*c* are configuration diagrams of the charging device;

FIG. 5 is a perspective view of a cleaner unit;

FIG. 6 is an exploded perspective view of the cleaner unit;

FIGS. 7*a* and 7*b* are exploded perspective views of cleaning pads;

FIGS. 8*a* and 8*b* show a grinding member, FIG. 8*a* being a sectional view and FIG. 8*b* being a microgram;

FIG. 9 is a transparent view of a part of the cleaner unit;

FIGS. 10*a* and 10*b* are transparent views of the cleaner unit, viewed from a positive side in a z direction while the cleaner unit is moving to a positive side in an x direction, FIG. 10*a* showing a lever and a switch, and FIG. 10*b* showing the cleaning pads;

FIGS. 11*a* and 11*b* are transparent views of the cleaner unit, viewed from a positive side in a z direction while the cleaner unit is moving to a negative side in the x direction, FIG. 11*a* showing the lever and the switch, and FIG. 10*b* showing the cleaning pads;

FIG. 12 is a graph showing the relationship between the number of reciprocations of the cleaner unit and the rank of image;

FIG. 13 is an illustration of a part of the charging device disclosed by Japanese Patent Laid-Open Publication No. 11-258891; and FIGS. 14*a* and 14*b* are illustrations showing wiping of a sheet electrode in the charging device shown by FIG. 13.

DETAILED DESCRIPTION OF THE PREFERRED EMBODIMENTS

A charging device according to a preferred embodiment of the present invention and an image forming apparatus provided with the charging device will be described with reference to the drawings.

General Structure of the Image Forming Apparatus

Figure 1:
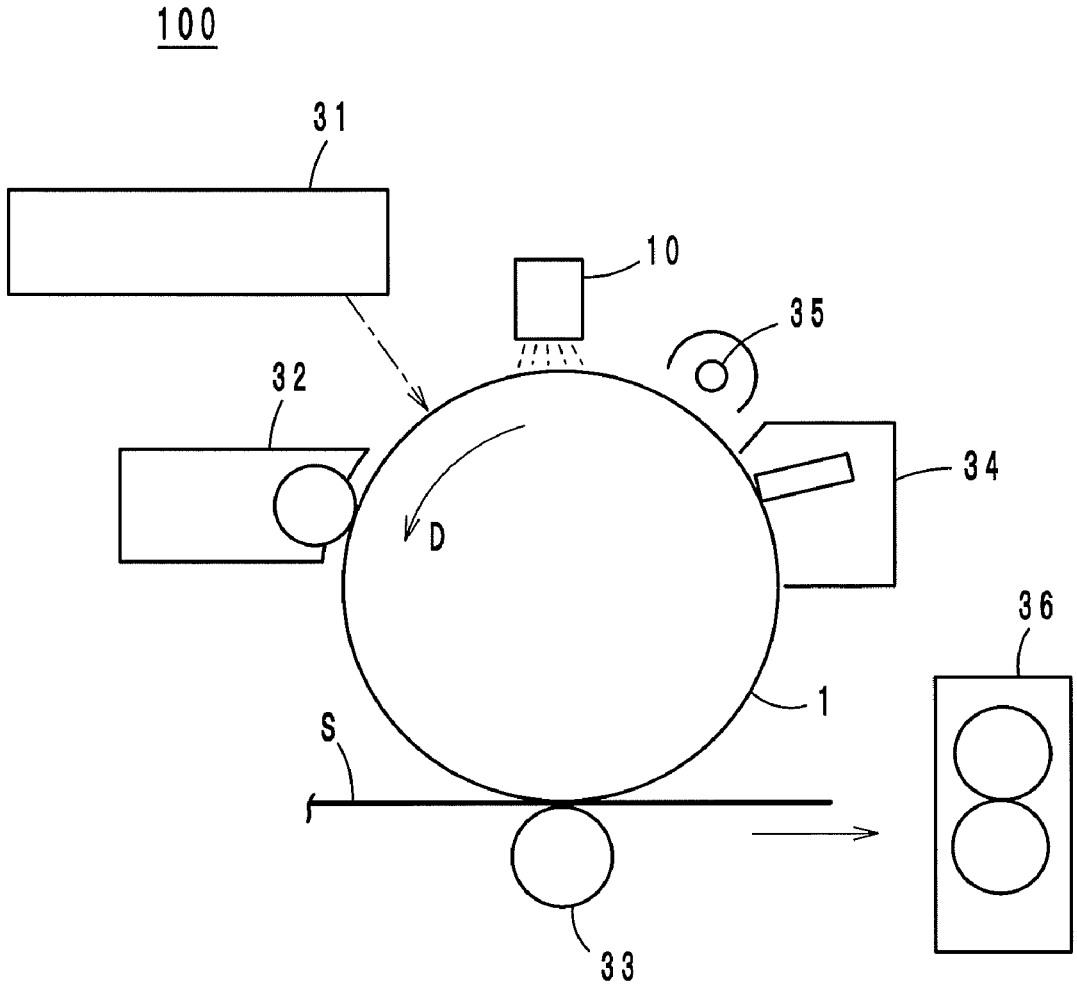
FIG. 1 is a skeleton framework of an image forming apparatus according to an embodiment of the present invention.

First, the general structure of an image forming apparatus according to an embodiment of the present invention is described. FIG. 1 shows the general structure of an image forming apparatus 100 according to an embodiment of the present invention. The image forming apparatus 100 according to this embodiment is a monochromatic or a color copying machine, printer, facsimile or a machine having these functions.

The image forming apparatus 100 comprises a photosensitive drum 1, a charging device 10, an optical scanning device 31, a developing device 32, a transfer roller 33, a cleaning device 34, an eraser lamp 35 and a fixing device 36. The photosensitive drum 1 is cylindrical and is driven by a motor (not shown) to rotate in a direction "D". An electrostatic latent image is formed on the surface of the photosensitive drum 1, and toner is applied to the surface thereof. Thus, the photosensitive drum 1 serves as an image bearing member for bearing a toner image in accordance with the electrostatic latent image.

The charging device 10 charges the surface of the photosensitive drum 1 evenly to a specified level. The optical scanning device 31 scans the surface of the photosensitive drum 1 with a beam modulated in accordance with image data and forms an electrostatic latent image on the surface of the photosensitive drum 1. The developing device 32 supplies toner onto the surface of the photosensitive drum 1, so that the electrostatic latent image is developed (visualized) into a toner image. The transfer roller 33 transfers the toner image formed on the surface of the photosensitive drum 1 to a sheet S traveling between the transfer roller 33 and the photosensitive drum 1. The fixing device 36 performs a heat/pressure treatment toward the sheet S so as to fix the toner on the sheet S.

The cleaning device 34 collects residual toner from the surface of the photosensitive drum 1. The eraser lamp 35 erases residual charge from the surface of the photosensitive drum 1.

Structure of the Charging device

Figure 2:
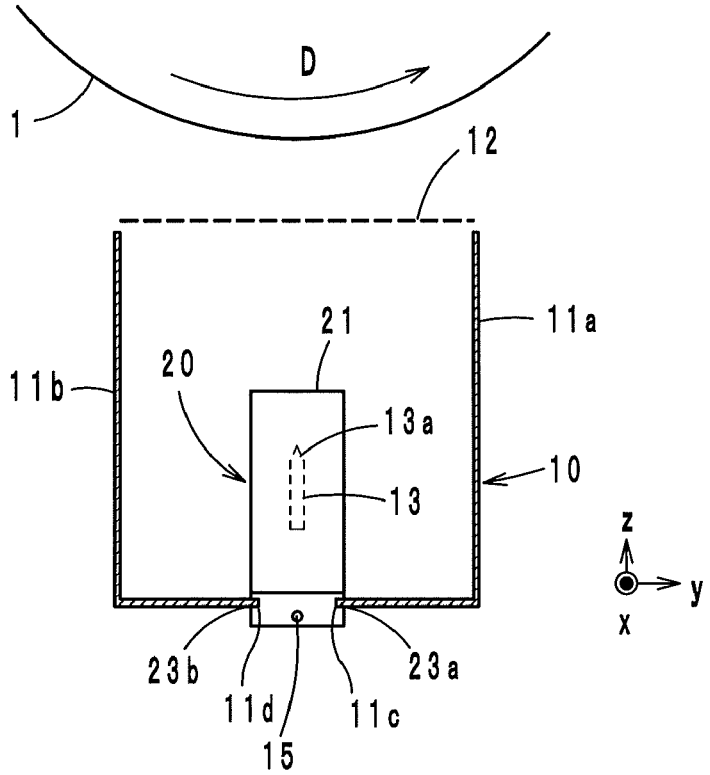
FIG. 2 is a skeleton framework of a charging device.
Figure 3:
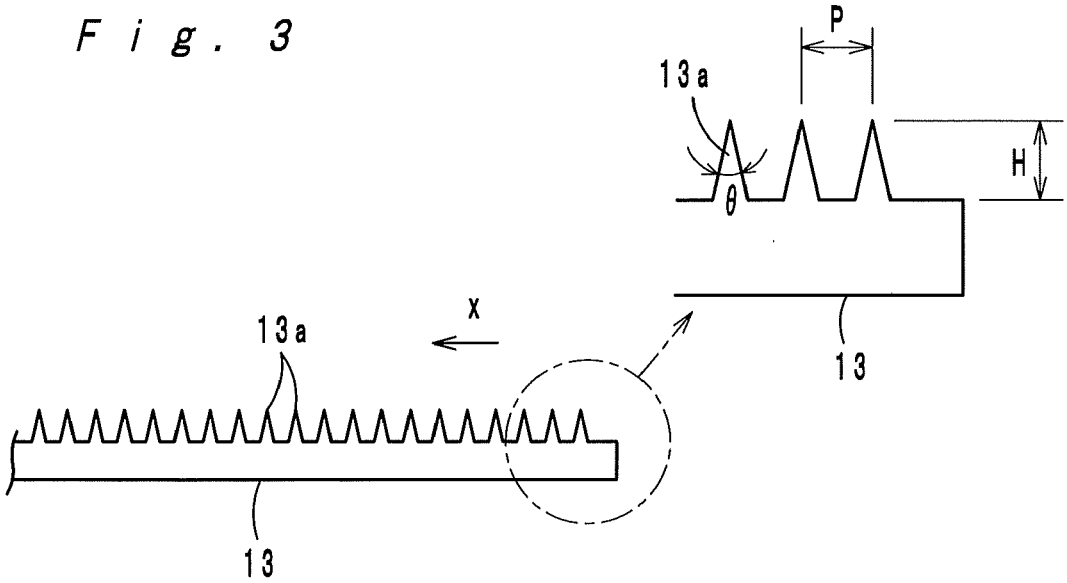
FIG. 3 is a configuration diagram of a sheet electrode provided in the charging device.

Next, the structure of the charging device 10 is described. FIG. 2 shows the general structure of the charging device 10. FIG. 3 shows the configuration of a sheet electrode 13 provided in the charging device 10. FIGS. 4*a*, 4*b* and 4*c* show the structure of the charging device 10 in more detail. FIG. 4*a* is a plan view, FIG. 4*b* is a front view, and FIG. 4*c* is a bottom view. FIG. 5 is a perspective view of a cleaner unit 20. FIG. 6 is an exploded perspective view of the cleaner unit 20. In the following paragraphs, the lengthwise direction of the charging device 10 (that is, main-scanning direction) is referred to as x direction, and the rotating direction of the photosensitive drum 1 (that is, sub-scanning direction) is referred to as y direction. The direction perpendicular to the x direction and the y direction is defined to be z direction.

As shown by FIGS. 2 and 4, the charging device 10 comprises stabilizing plates 11*a* and 11*b*, a mesh-type grid 12, holders 14*a* and 14*b*, a shaft 15, a motor 16 and supports 17*a* and 17*b*, as well as the sheet electrode 13 and the cleaner unit 20.

The stabilizing plates 11*a* and 11*b* have lengths in the x direction, each having an L-shape cross section. More specifically, as shown by FIG. 2, the stabilizing plate 11*a* also has a dimension in the z direction, and the end portion of the plate 11*a* at the negative side in the z direction is bent to the negative side in the y direction. Also, the stabilizing plate 11*b* has a dimension in the z direction, and the end portion of the plate 11*b* at the negative side in the z direction is bent to the positive side in the y direction. As seen in the cross sectional view of FIG. 2, the stabilizing plates 11*a* and 11*b* are U-shape in combination. The stabilizing plates 11*a* and 11*b* that are combined into U-shape have an opening that faces to the photosensitive drum 1. The mesh-type grid 12 is disposed at the opening of the stabilizing plates 11*a* and 11*b*. As shown in FIGS. 4*a*, 4*b* and 4*c*, the holders 14*a* and 14*b* are disposed at both ends in the lengthwise direction of the stabilizing plates 11*a* and 11*b* (in the x direction), and hold the stabilizing plates 11*a*, 11*b* and the mesh-type grid 12.

As shown by FIG. 2, the sheet electrode 13 is disposed in a space enclosed by the stabilizing plates 11*a*, 11*b* and the mesh-type grid 12 with its both ends held by the holders 14*a* and 14*b*. The sheet electrode 13 charges the surface of the photosensitive drum 1. In the following, the configuration of the sheet electrode 13 is described in detail.

As shown by FIG. 3, the sheet electrode 13 has a multiple of triangular pins 13*a* aligned in the x direction. The sheet electrode 13 has a thickness within a range from 40 μm to 60 μm. Each of the pins 13*a* has a vertex angle θ within a range from 5 degrees to 30 degrees and has a height H within a range from 1 mm to 3 mm. The pins 13*a* are arranged at a pitch P within a range from 1 mm to 3 mm. These values are designed for an efficient discharge. The sheet electrode 13 is made of stainless steel.

A voltage within a range from −6 kV to −7 kV (900 μA) is applied to the sheet electrode 13, and thereby, a corona discharge from the pins 13*a* to the photosensitive drum 1 occurs. Also, a voltage within a range from −300V to −900V is applied to the mesh-type grid 12, and thereby, the charge potential applied to the photosensitive drum 1 can be adjusted to a desired value.

As shown by FIGS. 5 and 6, the cleaner unit 20 comprises a frame 21, legs 22*a* and 22*b*, cleaning pads 24*a* and 24*b*, levers 26*a* and 26*b* and a switch 28. The frame 21 is a hollow parallelepiped. The frame 21 does not have surfaces on both sides in the x direction, and a rectangular through-hole is made to pierce through the frame 21 in the lengthwise direction of the sheet electrode 13 (in the x direction). In the frame 21, at the negative side in the z direction, grooves 23*a* and 23*b* are made to extend parallel to the x direction.

As shown in FIG. 5, the legs 22*a* and 22*b* are parallelepiped blocks stuck on the surface of the frame 21 at the negative side in the z direction. The legs 22*a* and 22*b* are disposed parallel to each other with a space in-between. As shown in FIG. 6, through-holes H1 and H2 are made in the legs 22*a* and 22*b*, respectively, to pierce in the x direction. Also, on both sides of the leg 22*a* in the y direction, grooves 23*a* and 23*b* are made to extend in the x direction. Likewise, on both sides of the leg 22*b* in the y direction, grooves 23*c* and 23*d* are made to extend in the x direction. As shown in FIG. 2, the respective ends of the L-shaped stabilizing plates 11*a* and 11*b* at the negative side in the z direction serve as rails 11*c* and 11*d*, and the rails 11*c* and 11*d* are inserted in the grooves 23*a* to 23*d*. Thereby, the frame 21 is capable of sliding in the lengthwise direction of the stabilizing plates 11*a* and 11*b*.

As shown in FIG. 5, the cleaning pads 24*a* and 24*b* are fitted in the frame 21 in positions to sandwich the sheet electrode 13. Thereby, the cleaning pads 24*a* and 24*b* nip the sheet electrode 13 in-between and remove extraneous matter from the sheet electrode 13. In the following, the structure of the cleaning pads 24*a* and 24*b* is described in detail. FIG. 7*a* is an exploded perspective view of the cleaning pad 24*a*. FIG. 7*b* is an exploded perspective view of the cleaning pad 24*b*.

The cleaning pad 24*a* comprises a supporting member 30*a*, a pressing member 32*a*, a grinding member 34*a* and collecting members 36*a* and 38*a*. The supporting member 30*a* is made of, for example, resin and comprises a base 40*a* and shafts 42*a* and 44*a*. The base 40*a* is a rectangular plate. The end portions of the base 40*a* at the positive side and the negative side in the z direction are bent to the negative side in the y direction. The shaft 42*a* is disposed in the bent portion of the base 40*a* at the positive end in the z direction and extends to the positive side in the z direction. The shaft 44*a* is disposed in the bent portion of the base 40*a* at the negative end in the z direction and extends to the negative side in the z direction.

The pressing member 32*a* is substantially in the same shape as the base 40*a*. The pressing member 32*a* is a rectangular plate of an elastic material (for example, urethane foam) and is stuck on the main surface of the base 40*a* at the negative side in the y direction. Urethane foam is advantageous of having a bare possibility of permanent deformation and of being unresolved by ozone. The pressing member 32*a* comprises three pressers 46*a*, 48*a* and 50*a*. The presser 48*a* is a strip extending in the z direction and is disposed in the center of the pressing member 32*a* with respect to the x direction. The presser 46*a* is a strip extending in the z direction parallel to the presser 48*a* and is disposed in the positive side of the presser 48*a* in the x direction. The presser 50*a* is a strip extending in the z direction parallel to the presser 48*a* and is disposed in the negative side of the presser 48*a* in the x direction. The pressers 46*a* and 50*a* are in the same shape, and the thicknesses of the pressers 46*a* and 50*a* (the dimensions thereof in the y direction) are smaller than that of the presser 48*a*. Thereby, the pressing member 32*a* has, in the center with respect to the x direction, a protrusive band extending in the z direction.

The grinding member 34*a* is stuck on the surface of the presser 48*a* at the negative side in the y direction and is a strip of the same size as the presser 48*a*. The grinding member 34*a* is to grind the sheet electrode 13. In the following, the grinding member 34*a* is described with reference to the drawings. FIG. 8*a* is a sectional view of the grinding member 34*a*, and FIG. 8*b* is a micrograph of the grinding member 34*a*. The grinding member 34*a* comprises a PET film 60, abrasive grains 62 and a binder 64. The PET film 60 is a base sheet and has a thickness within a range from 25 μm to 75 μm. The abrasive grains 62 have an average diameter within a range from 2 μm to 9 μm and are scattered on the PET film 60. For the abrasive grains 62, for example, a metal oxide, such as aluminum oxide, chrome oxide and iron oxide, or silicone carbide is used. The binder 64 binds the abrasive grains 62 so that the abrasive grains 62 will not fall off the PET film 60. As shown by FIGS. 8*a* and 8*b*, the abrasive grains 62 are bound by the binder 64 to stick together densely without spaces. Thus, the abrasive grains 62 and the binder 64 form an abrasive layer, and the abrasive layer has a thickness that is equal to or greater than 10 μm. As the grinding member 34*a*, for example, wrapping film sheets made by 3M, namely, model A3-2SHT (average diameter: 2 μm), model A3-3SHT (average diameter: 3 μm), model A3-5SHT (average diameter: 5 μm) and model A3-9SHT (average diameter: 9 μm) may be used. The wrapping film sheets made by 3M comprise abrasive grains of aluminum oxide.

As shown in FIG. 7*a*, the collecting members 36*a* and 38*a* are stuck respectively on the main surfaces of the pressers 46*a* and 50*a* at the negative side in the y direction and are strips of the same size as the pressers 46*a* and 50*a*. Thus, the collecting member 36*a* is disposed in the positive side of the grinding member 34*a* with respect to the x direction, and the collecting member 38*a* is disposed in the negative side of the grinding member 34*a* with respect to the x direction. For the collecting members 36*a* and 38*a*, a material that is suited to wipe extraneous matter off the sheet electrode 13 is selected. For example, pile fabric such as velvet and Teflon pile (Teflon: trade name), napped fabric or nonwoven fabric is used.

As shown in FIG. 7*a*, the presser 48*a* protrudes from the other pressers 46*a* and 50*a* to the negative side in the y direction. Accordingly, the grinding member 34*a* protrudes from the collecting members 36*a* and 38*a* to the negative side in the y direction.

The cleaning pad 24*b* comprises a supporting member 30*b*, a pressing member 32*b*, a grinding member 34*b* and collecting members 36*b* and 38*b*. The supporting member 30*b* is made of, for example, resin and comprises a base 40*b* and shafts 42*b* and 44*b*. The base 40*b* is a rectangular plate. The end portions of the base 40*b* at the positive side and the negative side in the z direction are bent to the positive side in the y direction. The shaft 42*b* is disposed in the bent portion of the base 40*b* at the positive end in the z direction and extends to the positive side in the z direction. The shaft 44*b* is disposed in the bent portion of the base 40*b* at the negative end in the z direction and extends to the negative side in the z direction.

The pressing member 32*b* is substantially in the same shape as the base 40*b*. The pressing member 32*b* is a rectangular plate of an elastic material (for example, urethane foam) and is stuck on the main surface of the base 40*b* at the positive side in the y direction. The pressing member 32*b* comprises three pressers 46*b*, 48*b* and 50*b*. The presser 48*b* is a strip extending in the z direction and is disposed in the center of the pressing member 32*b* with respect to the x direction. The presser 46*b* is a strip extending in the z direction parallel to the presser 48*b* and is disposed in the positive side of the presser 48*b* in the x direction. The presser 50*b* is a strip extending in the z direction parallel to the presser 48*b* and is disposed in the negative side of the presser 48*b* in the x direction. The pressers 46*b* and 50*b* are in the same shape, and the thicknesses of the pressers 46*b* and 50*b* (the dimensions thereof in the y direction) are smaller than that of the presser 48*b*. Thereby, the pressing member 32*b* has, in the center with respect to the x direction, a protrusive band extending in the z direction.

The grinding member 34*b* is stuck on the surface of the presser 48*b* at the negative side in the y direction and is a strip of the same size as the presser 48*b*. The grinding member 34*b* is to grind the sheet electrode 13. The grinding member 34*b* is of the same structure as the grinding member 34*a*, and the description of the grinding member 34*b* is omitted.

As shown in FIG. 7*b*, the collecting members 36*b* and 38*b* are stuck respectively on the main surfaces of the pressers 46*b* and 50*b* at the positive side in the y direction and are strips of the same size as the pressers 46*b* and 50*b*. Thus, the collecting member 36*b* is disposed in the positive side of the grinding member 34*a* with respect to the x direction, and the collecting member 38*b* is disposed in the negative side of the grinding member 34*b* with respect to the x direction. For the collecting members 36*b* and 38*b*, a material that is suited to wipe extraneous matter off the sheet electrode 13 is selected. For example, pile fabric such as velvet and Teflon pile (Teflon: trade name), napped fabric or nonwoven fabric is used.

As shown in FIG. 7*b*, the presser 48*b* protrudes from the other pressers 46*b* and 50*b* to the positive side in the y direction. Accordingly, the grinding member 34*b* protrudes from the collecting members 36*b* and 38*b* to the positive side in the y direction.

The cleaning pads 24*a* and 24*b* of the structure above are fitted in the frame 21 such that the grinding members 34*a* and 34*b* face to each other, such that the collecting members 36*a* and 36*b* face to each other and such that the collecting members 38*a* and 38*b* face to each other. As shown in FIG. 6, holes h1 and h2 are made in the side of the frame 21 at the positive side in the z direction, and holes h3 and h4 are made in the side of the frame 21 at the negative side in the z direction. The shafts 42*a*, 42*b*, 44*a* and 44*b* (see FIGS. 7*a* and 7*b*) are inserted in the holes h1, h2, h3 and h4, respectively. In this way, the cleaning pad 24*a* is fitted in the frame 21 to be capable of pivoting on the shafts 42*a* and 44*a*. Likewise, the cleaning pad 24*b* is fitted in the frame 21 to be capable of pivoting on the shafts 42*b* and 44*b*. In this state, there is a space between the grinding members 34*a* and 34*b*, and there are spaces between the collecting members 36*a* and 36*b* and between the collecting members 38*a* and 38*b*. The space between the grinding members 34*a* and 34*b* is smaller than the space between the collecting members 36*a* and 36*b* and the space between the collecting members 38*a* and 38*b*.

In the cleaner unit 20 of the structure above, as shown by FIG. 5, the sheet electrode 13 pierces through the space between the cleaning pads 24*a* and 24*b*. In this state, the grinding members 34*a* and 34*b* are pressed against the respective main surfaces of the sheet electrode 13 by the elastic force of the pressers 48*a* and 48*b*.

The levers 26*a* and 26*b* are connected to the cleaning pads 24*a* and 24*b*, respectively. FIG. 9 is a transparent view of a part of the cleaner unit 20. The lever 26*a* is fitted to the shaft 44*a* inserted in the hole h3. Thereby, the lever 26*a* is capable of pivoting on the shafts 42*a* and 44*a* together with the cleaning pad 24*a*. The lever 26*b* is fitted to the shaft 44*b* inserted in the hole h4. Thereby, the lever 26*b* is capable of pivoting on the shafts 42*b* and 44*b* together with the cleaning pad 24*b*.

As shown in FIG. 6, the switch 28 comprises plates 29*a* and 29*b*, and a connector 29*c*. The plates 29*a* and 29*b* are rectangular, and the connector 29*c* connects the plates 29*a* and 29*b* to each other. A hole H3 is made to pierce through the plates 29*a*, 29*b* and the connector 29*c*. The connector 29*c* is tubular and connects the hole made in the plate 29*a* and the hole made in the plate 29*b* to each other. Thereby, the hole H3 extending in the x direction is made. The hole H3 has an internal thread and serves as a female screw.

As shown by FIG. 9, the switch 28 of the structure above is disposed such that the plates 29*a* and 29*b* sandwich the levers 26*a* and 26*b* in-between and that the holes H1 to H3 (although the hole H2 is not shown in FIG. 9) come into line in the x direction.

The shaft 15 is a male screw and as shown in FIGS. 4*b* and 4*c*, extends in the x direction in the side of the stabilizing plates 11*a* and 11*b* at a negative side in the z direction. The shaft 15 pierces through the holes H1 to H3 shown in FIG. 9. In this state, the shaft 15 and the switch 28 screw together. On the other hand, since the holes H1 and H2 do not have internal threads, the shaft 15 and the legs 22*a* and 22*b* do not screw together.

The supports 17*a* and 17*b* are fixed on the surfaces of the holders 14*a* and 14*b*, respectively, at the negative side in the z direction, and the supports 17*a* and 17*b* have through-holes. The shaft 15 pierces through the through-holes of the supports 17*a* and 17*b*. The shaft 15 is supported by the supports 17*a* and 17*b* to be capable of rotating.

The motor 16, which is to rotate the shaft 15, is connected to the end of the shaft 15 at a negative side in the x direction. When the shaft 15 is rotated by the motor 16, the switch 28 that screws with the shaft 15 is moved to the positive side or the negative side in the x direction. Then, the switch 28 pushes the leg 22*a* or the leg 22*b*, and thereby, the cleaner unit 20 is moved to the positive side or the negative side in the x direction.

Operation of the Cleaner Unit

Next, the operation of the cleaner unit 20 is described with reference to the drawings. FIGS. 10*a* and 10*b* show the state wherein the cleaner unit 20 is moving to the positive side in the x direction. FIG. 10*a* is a transparent view of the levers 26*a* and 26*b* and the switch 28 of the cleaner unit 20, viewed from the positive side with respect to the z direction. FIG. 10*b* is a transparent view of the cleaning pads 24*a* and 24*b* of the cleaner unit 20, viewed from the positive side with respect to the z direction. FIGS. 11*a* and 11*b* show the state wherein the cleaner unit 20 is moving to the negative side in the x direction. FIG. 10*a* is a transparent view of the levers 26*a* and 26*b* and the switch 28 of the cleaner unit 20, viewed from the positive side with respect to the z direction. FIG. 10*b* is a transparent view of the cleaning pads 24*a* and 24*b* of the cleaner unit 20, viewed from the positive side with respect to the z direction.

The cleaning pads 24*a* and 24*b* clean the both main surfaces of the sheet electrode 13 while reciprocating in the x direction keeping in contact with the main surfaces of the sheet electrode 13. In the operation, the levers 26*a* and 26*b* and the switch 28 serve as a switching section to switch the contact state of the collecting members 36*a* and 36*b* with the sheet electrode 13 and the contact state of the collecting members 38*a* and 38*b* with the sheet electrode 13. While the cleaner unit 20 is moving to the positive side in the x direction, the pressure applied to the collecting members 38*a* and 38*b* to lean against the sheet electrode 13 is greater than the pressure applied to the collecting members 36*a* and 36*b* to lean against the sheet electrode 13. While the cleaner unit 20 is moving to the negative side in the x direction, the pressure applied to the collecting members 36*a* and 36*b* to lean against the sheet electrode 13 is greater than the pressure applied to the collecting members 38*a* and 38*b* to lean against the sheet electrode 13. Especially in this embodiment, while the cleaner unit 20 is moving to the positive side in the x direction, the collecting members 38*a* and 38*b* are pressed against the sheet electrode 13, whereas the collecting members 36*a* and 36*b* are kept out of contact with the sheet electrode 13. While the cleaner unit 20 is moving to the negative side in the x direction, the collecting members 36*a* and 36*b* are pressed against the sheet electrode 13, whereas the collecting members 38*a* and 38*b* are kept out of contact with the sheet electrode 13.

First, the operation of the switching section when the cleaner unit 20 moves to the positive side in the x direction is described. For the motion of the cleaner unit 20 to the positive side in the x direction, the motor 16 rotates the shaft 15 in a first direction. The switch 28 is disposed in contact with the side of the frame 21 at the negative side in the z direction, and the switch 28 does not rotate on the shaft 15. Meanwhile, the switch 28 screws with the shaft 15. Thereby, the switch 28 is pushed to the positive side in the x direction. Then, as shown by FIG. 10*a*, the plate 29*a* comes into contact with the leg 22*a*, and the plate 29*b* comes into contact with the levers 26*a* and 26*b*. In this moment, the lever 26*a* is pushed to the positive side in the x direction and slightly pivots counterclockwise, and the lever 26*b* is pushed to the positive side in the x direction and slightly pivots clockwise. Accordingly, as shown by FIG. 10*b*, the cleaning pad 24*a* pivots counterclockwise, and the cleaning pad 24*b* pivots clockwise. Thereby, the space between the collecting members 38*a* and 38*b* becomes smaller than the space between the collecting members 36*a* and 36*b*. In this state, the collecting members 38*a* and 38*b* are in contact with the sheet electrode 13, and the collecting members 36*a* and 36*b* are out of contact with the sheet electrode 13. The space between the grinding members 34*a* and 34*b* is designed to be smaller than the spaces between the collecting members 36*a* and 36*b* and between the collecting members 38*a* and 38*b*. Therefore, even in the state shown by FIGS. 10*a* and 10*b*, the grinding members 34*a* and 34*b* are in contact with the sheet electrode 13.

The motor 16 further rotates the shaft 15, and thereby, the plate 29*a* pushes the leg 22*a* to the positive side in the x direction. Accordingly, the cleaner unit 20 moves to the positive side in the x direction along the sheet electrode 13. During this motion of the cleaner unit 20, the grinding members 34*a* and 34*b* grind the sheet electrode 13 and chip away corona products from the sheet electrode 13, and the collecting members 38*a* and 38*b* collect (wipe) the abrasive grains peeling off the grinding members 34*a* and 34*b* and the corona products chipped away from the sheet electrode 13. In this way, corona products are removed from the sheet electrode 13.

Next, the operation of the switching section when the cleaner unit 20 moves to the negative side in the x direction is described. For the motion of the cleaner unit 20 to the negative side in the x direction, the motor 16 rotates the shaft 15 in a direction opposite to the first direction. The switch 28 is in contact with the side of the frame 21 at the negative side in the z direction, and the switch 28 does not rotate on the shaft 15. Meanwhile, the switch 28 screws with the shaft 15. Thereby, the switch 28 is pushed to the negative side in the x direction. Then, as shown by FIG. 11*a*, the plate 29*a* comes into contact with the leg 22*b*, and the plate 29*a* comes into contact with the levers 26*a* and 26*b*. In this moment, the lever 26*a* is pushed to the negative side in the x direction and slightly pivots clockwise, and the lever 26*b* is pushed to the negative side in the x direction and slightly pivots counterclockwise. Accordingly, as shown by FIG. 11*b*, the cleaning pad 24*a* pivots clockwise, and the cleaning pad 24*b* pivots counterclockwise. Thereby, the space between the collecting members 36*a* and 36*b* becomes smaller than the space between the collecting members 38*a* and 38*b*. In this state, the collecting members 36*a* and 36*b* are in contact with the sheet electrode 13, and the collecting members 38*a* and 38*b* are out of contact with the sheet electrode 13. The space between the grinding members 34*a* and 34*b* is designed to be smaller than the spaces between the collecting members 36*a* and 36*b* and between the collecting members 38*a* and 38*b*. Therefore, even in the state shown by FIGS. 11*a* and 11*b*, the grinding members 34*a* and 34*b* are in contact with the sheet electrode 13.

The motor 16 further rotates the shaft 15, and thereby, the plate 29*b* pushes the leg 22*b* to the negative side in the x direction. Accordingly, the cleaner unit 20 moves to the negative side in the x direction along the sheet electrode 13. During this motion of the cleaner unit 20, the grinding members 34*a* and 34*b* grind the sheet electrode 13 and chip away corona products from the sheet electrode 13, and the collecting members 36*a* and 36*b* collect (wipe) the abrasive grains peeling off the grinding members 34*a* and 34*b* and the corona products chipped away from the sheet electrode 13. In this way, corona products are removed from the sheet electrode 13.

Advantages

In the charging device 10, as will be described later, breaks of the triangular pins 13*a* of the sheet electrode 13 can be prevented. Referring to FIGS. 14*a* and 14*b*, in the conventional charging device, when the pieces of pile fabric 602 are moved in the direction "B" and thereafter moved in the direction "C" opposite to the direction "B", the fibers of the pile fabric 602 may twist around the pins of the sheet electrode 600. More specifically, as shown by FIG. 14*a*, while the pieces of pile fabric 602 are moving in the direction "B", the fibers of the pile fabric 602 are pulled by a frictional force with the sheet electrode 600 and trail down slanting to the direction "C", which is the opposite direction to the direction "B". Thereafter, when the pieces of pile fabric 602 are moved in the direction "C" shown by FIG. 14*b*, the fibers of the pile fabric 602 are pulled in the direction "B" and are turning around from the direction "C" to the direction "B". In this moment, the fibers of the pile fabric 602 may twist around the pins of the sheet electrode 600, whereby the pins of the sheet electrode 600 may be bent and/or broken.

In the charging device 10, in order to avoid this trouble, when the direction of motion of the cleaner unit 20 is switched over, the contact state of the collecting members 36*a* and 36*b* with the sheet electrode 13 and the contact state of the collecting members 38*a* and 38*b* with the sheet electrode 13 are switched. More specifically, while the cleaner unit 20 is moving to the positive side in the x direction, the switching section composed of the levers 26*a*, 26*b* and the switch 28 operates such that the collecting members 38*a* and 38*b* are pressed against the sheet electrode 13 with greater force than the collecting members 36*a* and 36*b* are pressed against the sheet electrode 13. While the cleaner unit 20 is moving to the negative side in the x direction, the switching section operates such that the collecting members 36*a* and 36*b* are pressed against the sheet electrode 13 with greater force than the collecting members 38*a* and 38*b* are pressed against the sheet electrode 13. With this arrangement, the collecting members 38*a* and 38*b* are pressed against the sheet electrode 13 strongly only while the cleaner unit 20 is moving to the positive side in the x direction, whereas the collecting members 36*a* and 36*b* are pressed against the sheet electrode 13 strongly only while the cleaner unit 20 is moving to the negative side in the x direction. Thus, even when the collecting members 36*a*, 36*b*, 38*a* and 38*b* are pile fabric, it is suppressed that the fibers of the pile fabric turn around every time the direction of motion of the cleaner unit 20 is switched over. Consequently, the fibers of the collecting members 36*a*, 36*b*, 38*a* and 38*b* can be suppressed from twisting around the pins 13*a* of the sheet electrode 13, and the pins 13*a* and the sheet electrode 13 can be prevented from being broken.

Especially in the charging device 10, the switching section composed of the levers 26*a*, 26*b* and the switch 28 operates such that while the cleaner unit 20 is moving to the positive side in the x direction, the collecting members 38*a* and 38*b* are in contact with the sheet electrode 13, whereas the collecting members 36*a* and 36*b* are out of contact with the sheet electrode 13, and such that while the cleaner unit 20 is moving to the negative side in the x direction, the collecting members 36*a* and 36*b* are in contact with the sheet electrode 13, whereas the collecting members 38*a* and 38*b* are out of contact with the sheet electrode 13. Thereby, the fibers of the collecting members 36*a*, 36*b*, 38*a* and 38*b* do not turn around. Therefore, breaks of the pins 13*a* of the sheet electrode 13 can be prevented more effectively.

The inventors made an experiment so as to certify that the charging device 10 has the above-described advantage. The inventors fabricated a first sample of the charging device 10 according to this embodiment and fabricated a second sample wherein the cleaning pads 24*a* and 24*b* do not pivot. Then, in each of the first and second samples, the cleaner unit 20 was reciprocated, and it was examined whether image noise occurred. FIG. 12 is a graph showing the relationship between the number of reciprocations of the cleaner unit 20 and the rank of image. The y axis shows the rank of image, and the x axis shows the number of reciprocations.

The rank of image is determined based on the width of a black stripe (image noise) that occurred on an image. More specifically, the rank 5 means that the width of a black stripe on an image was 0 mm. The rank 4 means that the width of a black stripe on an image was 1 mm. The rank 3 means that the width of a black stripe on an image was 1.5 mm. The rank 2 means that the width of a black stripe on an image was 2.5 mm. The rank 1 means that the width of a black stripe on an image was 4 mm. Images of rank 3 or more are good.

As shown in FIG. 12, in the second sample, when the cleaner unit was reciprocated within a number of times from three to five, the rank of image was 3, which was the peak. Then, when the cleaner unit was reciprocated more than five times, the rank of image degraded. It is considered that the pins of the sheet electrode were broken by the reciprocation of the cleaner unit, thereby causing a discharge fault.

On the other hand, in the first sample, as the number of reciprocations of the cleaner unit 20 was increasing, the rank of image became higher. Thus, it is considered that in the cleaner unit 20 of the first sample, the pins 13*a* of the sheet electrode 13 were not broken. As a result of this experiment, it was found out that in the charging device 10, breaks of the pins 13*a* of the sheet electrode 13 can be prevented.

As has been described above, in the charging device 10 according to this embodiment, breaks of the triangular pins 13*a* of the sheet electrode 13 can be prevented.

Although the present invention has been described in connection with the preferred embodiment above, it is to be noted that various changes and modifications are possible to those who are skilled in the art. Such changes and modifications are to be understood as being within the scope of the present invention.

What is claimed is:

1. A charging device comprising:

a sheet electrode for charging an image bearing member, the sheet electrode comprising triangular pins aligned in a first direction;

a cleaner unit for cleaning the sheet electrode while moving in the first direction and in a second direction opposite to the first direction, the cleaner unit comprising:

a grinding member for grinding the sheet electrode;

a first collecting member for collecting extraneous matter, the first collecting member being disposed downstream in the first direction from the grinding member;

a second collecting member for collecting extraneous matter, the second collecting member being disposed downstream in the second direction from the grinding member;

a switching section for switching a contact state of the first collecting member with the sheet electrode and a contact state of the second collecting member with the sheet electrode, such that while the cleaner unit is moving in the first direction, the second collecting member is pressed against the sheet electrode with greater force than the first collecting member is pressed against the sheet electrode, and such that while the cleaner unit is moving in the second direction, the first collecting member is pressed against the sheet electrode with greater force than the second collecting member is pressed against the sheet electrode.

2. A charging device according to claim 1, wherein while the cleaner unit is moving in the first direction, the switching section brings the second collecting member in contact with the sheet electrode and brings the first collecting member out of contact with the sheet electrode, and while the cleaner unit is moving in the second direction, the switching section brings the first collecting member in contact with the sheet electrode and brings the second collecting member out of contact with the sheet electrode.

3. A charging device according to claim 1, wherein the grinding member, the first collecting member and the second collecting member are respectively provided in pairs such that the respective pairs sandwich the sheet electrode from both sides, so that the extraneous matter can be chipped off and collected from the both sides of the sheet electrode.

4. A charging device according to claim 1, wherein the first collecting member and the second collecting member are made of fabric and wipe the extraneous matter.

5. A charging device according to claim 4, wherein the first collecting member and the second collecting member are made of pile fabric.

6. A charging device according the claim 1, wherein the grinding member comprises abrasive grains.

7. An image forming apparatus comprising a charging device according to claim 1.

* * * * *